US005941569A

United States Patent [19]

Solomons

[11] Patent Number: 5,941,569

[45] Date of Patent: Aug. 24, 1999

[54] ALBUM BINDING SYSTEM

[76] Inventor: Julian Stuart Solomons, 7 Sandpiper, Irvine, Calif. 92604

[21] Appl. No.: 08/928,715

[22] Filed: Sep. 12, 1997

[51] Int. Cl.[6] ..... B42D 1/08

[52] U.S. Cl. ..... 281/21.1; 287/15.1; 287/28; 287/36

[58] Field of Search ..... 281/21.1, 15.1, 281/28, 36, 22, 40; 402/8

[56] References Cited

U.S. PATENT DOCUMENTS

| | | | |
|---|---|---|---|
| 218,283 | 8/1879 | Lamb | 281/40 |
| 434,160 | 8/1890 | Rubel . | |
| 475,259 | 5/1892 | Turck . | |
| 475,425 | 5/1892 | Vawter et al. . | |
| 478,035 | 6/1892 | Thuge . | |
| 649,061 | 5/1900 | Leechman | 281/40 |
| 674,443 | 5/1901 | Jones | 281/40 |
| 851,546 | 4/1907 | Mudd | 281/21.1 |
| 943,479 | 12/1909 | Smithson | 281/40 |
| 1,406,166 | 2/1922 | Bennett et al. . | |
| 1,443,522 | 1/1923 | Buchan . | |
| 1,639,821 | 8/1927 | Vogel . | |
| 1,741,909 | 12/1929 | Belohlavek . | |
| 1,918,474 | 7/1933 | Hotchkiss | 281/40 |
| 2,347,278 | 4/1944 | Pitt | 129/37 |
| 2,600,657 | 6/1952 | Jones | 281/15.1 |
| 4,114,240 | 9/1978 | Nackenson | 24/67.11 |
| 4,259,799 | 4/1981 | Fulton, Jr. . | |
| 4,743,048 | 5/1988 | Groswith, III | 281/21.1 |
| 4,934,738 | 6/1990 | Colonna | 281/21.1 |
| 5,002,447 | 3/1991 | Borel | 281/21.1 |
| 5,104,147 | 4/1992 | King | 281/21.1 |
| 5,193,581 | 3/1993 | Honeggar | 281/15.1 |
| 5,299,898 | 4/1994 | Kaufmann et al. | 281/21.1 |
| 5,636,869 | 6/1997 | Holmes | 281/21.1 |

FOREIGN PATENT DOCUMENTS

| | | | |
|---|---|---|---|
| 2145033 | 3/1985 | United Kingdom | 281/21.1 |

*Primary Examiner*—Frances Han

*Attorney, Agent, or Firm*—Gene Scott-Patent Law & Venture Group

[57] ABSTRACT

The present invention provides an album apparatus comprising an album binder and a plurality of an album leaf. Each album leaf, preferably a sheet of a flexible material, provides a binding portion and a page portion interconnected by a linear fold portion. The linear fold portion allows flexible, pivotal rotation of each one of the associated page portions with respect to each one of the associated binding portions of the album leaf. The album binder has a resiliently flexible binder spine which is hinged to a pair of binder covers. The fold portion preferably includes a plurality of perforations therein, the perforations being linearly aligned for establishing a preferred fold line in the material sheet. The binding portion of each album leaf is clamped to the binder spine, such that the binding portion extends outside of the binder spine and the linear fold portion is above the hinged connection between the binder cover and the binder spine.

10 Claims, 3 Drawing Sheets

ALBUM BINDING SYSTEM

BACKGROUND OF THE INVENTION

1. Field of the Invention

This invention relates generally to albums, and more particularly to an album binder apparatus which removably engages a plurality of album leafs which are capable of laying flat when the album is open.

2. Description of Related Art

The following art defines the present state of this field:

Rubel, U.S. Pat. No. 434,160 describes a simple, economical, and efficient device for binding and holding separate sheets of paper, such as express-blanks, for example.

Vernon, U.S. Pat. No. 463,323 describes binding attachments and covers for the reception or removal of sheets of paper combined in book or other form. The invention applies therefore to a binding-cover of durable character, which outlasts the memorandum-pages temporarily inserted therein and to be removed when consumed for the substitution of others. This invention provides the temporary biding of paper or books or pads of varying thickness or to permit the independent insertion or removal of separate sheets or cards of paper in addition to those first put in.

Turck, U.S. Pat. No. 475,259 describes devices for temporarily holding one or a plurality of sheets of paper between the covers of a book or holder, such as are commonly in use by shipping-clerks, express-messengers, and the like. The invention consists more particularly in the means employed, whereby the sheets of paper are removably held in position.

Vawter et al., U.S. Pat. No. 475,425 describes a binder used for holding separate leaves of paper in such manner that any one or more of them may be readily inserted or removed. The invention has for its object to provide a holder of this class which is cheap in construction, durable, and convenient in operation.

Thuge, U.S. Pat. No. 478,035 describes an order-holder into which a number of orders or sheets of other matter can be inserted and securely held. This holder is very simple and cheap in construction and can be readily manipulated to insert or withdraw the orders therefrom.

Bennett et al., U.S. Pat. No. 1,406,166 describes books having renewable or interchangeable leaves and more particularly to sales books, pocket books and other comparatively small books of that type. The object of the invention is to provide an extremely simple and inexpensive means for retaining the leaves of a book within its cover in such a manner that they may be readily withdrawn and replaced or renew primarily applicable to books having single loose leaves adapted to be withdrawn and replaced independently of each other.

Buchan, U.S. Pat. No. 1,443,522 describes an improved spring binder and the method of assembling the same to permit loose leaves, pamphlets, magazines and the like to be removable clamped in place between the binder covers. This invention provides an improved type of a binder wherein the back clips or springs are adapted to be clamped to the binding by split springs tubes.

Vogel, U.S. Pat. No. 1,639,821 describes book covers of the type in which the leaves are removably held within the cover by a C-shaped clamping spring embracing the back of the cover, the clamping spring being slid on in a longitudinal direction and taken off in the same way.

Belohlavek, U.S. Pat. No. 1,741,909 describes improvements in loose leaf binders and has among its objects to provide a new and improved construction in loose leaf binders which shall afford a binder of simple construction yet durable and efficient in operation. It also provides the back of a binder of this character with a plurality of spaced resilient members or clips having their free edges interconnected with metallic strips whereby the pressure from the resilient members will be distributed along the binding or gripping edges of the back of the binder.

Pitt, U.S. Pat. No. 2,347,278 describes a loose-leaf binder having a spring clamp bound in its back member to hold a plurality of unpunched sheets securely. It is an object of this invention to provide a loose-leaf binder that will be inexpensive to assemble and will be extremely durable in use. It is a further object of this invention to provide a loose leaf binder with spring clamp on the inside of the binder back so that the outer configuration of the back is smooth and pleasing to the eye. This binder also has a spring clamp which is mounted after the case member is completely bound.

Nackenson, U.S. Pat. No. 4,114,246 describes a round back spring binder having spring clamp elements formed with intersecting end portions which have to be spread apart in order to assemble the spring clamp elements into the binder, thereby pre-loading the back of the binder with an initial spring bias. When spread apart, the end portions of the spring clamp elements area angled toward a common line which is centered with respect to the back of the binder.

The prior art teaches C-shaped binders which allow addition and removal of pages. However, the prior art does not teach an apparatus which includes album leafs which are capable of laying flat when the album is open. The present invention fulfills this need and provides further related advantages as described in the following summary.

SUMMARY OF THE INVENTION

The present invention teaches certain benefits in construction and use which give rise to the objectives described below.

The present invention provides an album apparatus comprising an album binder and a plurality of an album leaf means. Each one of the album leaf means provides a binding portion and a page portion interconnected by a linear fold portion. The album binder has a resiliently flexible binder spine means and hinged thereto, a binder cover means. Each of the album leafs is preferably a sheet of a flexible material. Each of the fold portions enables flexible, pivotal rotation of each one of the associated page portions with respect to each one of the associated binding portions of the album leaf means, for turning the page portions within the album binder. The fold portion preferably includes a plurality of perforations therein, the perforations being linearly aligned for establishing a preferred fold line in the material sheet. The binding portion of each album leaf is long enough to extend out of the binder spine means, such that when the album leaf means is inserted into and clamped by the binder spine means, the binding portion extends outside of the binder spine means and the linear fold portion is above the hinged connection between the binder cover means and the binder spine means.

A primary objective of the present invention is to provide an album binder apparatus which removably engages a plurality of album leafs which are capable of laying flat when the album is open. Such an album binder has advantages not taught by the prior art.

A further objective of the invention is to provide such a binder and leafs that are capable of enclosing sheets of printed matter, photographs, etc.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention. In such drawings.

While these drawing, for improved illustration, show the album having a relatively large binder spine means and binder portion; however, these elements would most likely be rather small and compact in comparison to the rest of the binder. The enlarged size is purely for the purpose of showing the details of the binder portion.

DETAILED DESCRIPTION OF THE INVENTION

The above described drawing figures illustrate the invention, an album apparatus 5 comprising a plurality of an album leaf means 10 and an album binder 20.

Figure 1:
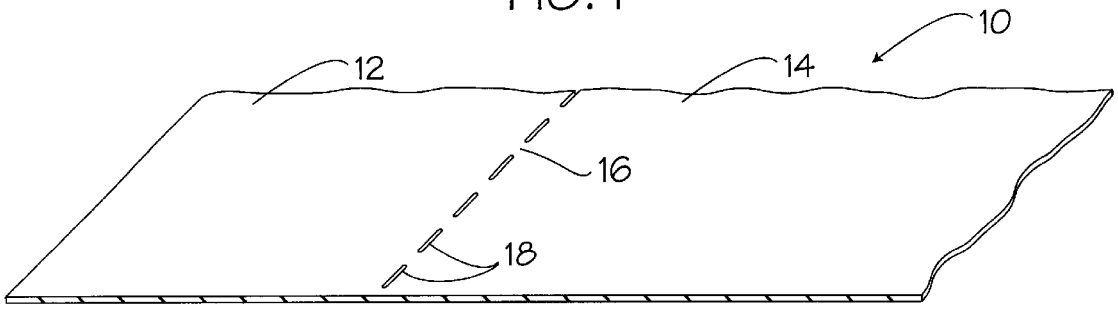
FIG. 1 is a sectional perspective view of a portion of an album leaf showing a perforation for enabling a preferred folding of the leaf.
Figure 2:
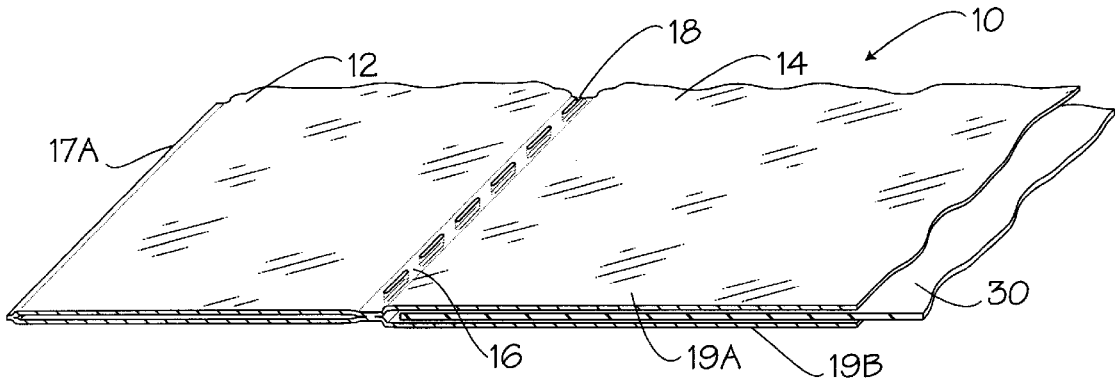
FIG. 2 is a sectional perspective view of a portion of an album leaf of the envelope type, showing a construction and perforation for enabling a preferred folding of the leaf.
Figure 3:
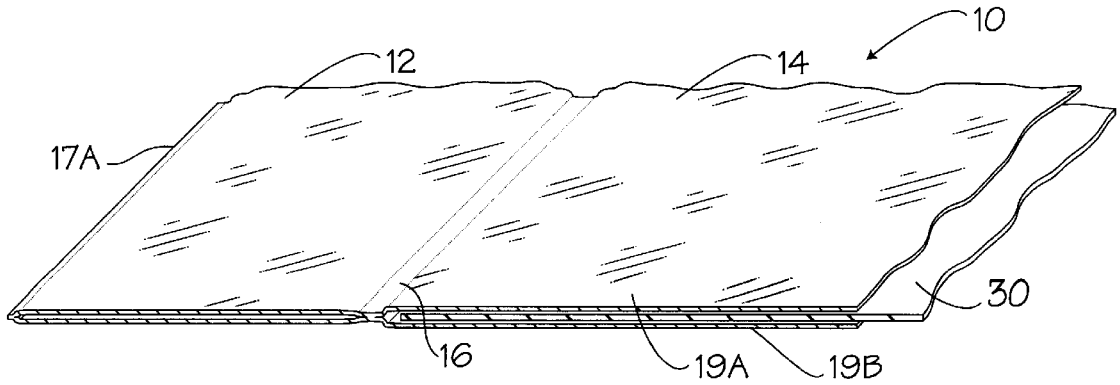
FIG. 3 shows a construction similar to that of FIG. 2 but without the perforation.
Figure 4:
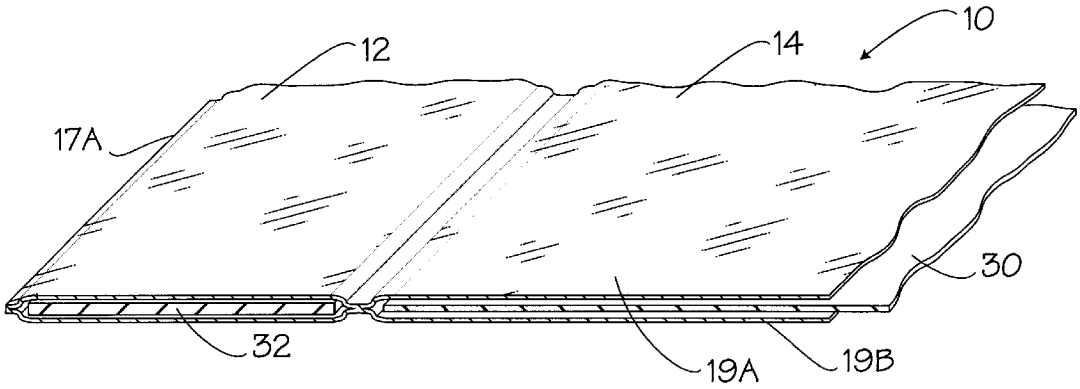
FIG. 4 shows a construction similar to that of FIG. 3 but including a stiffener in the binder portion of the album leaf.
Figure 6:
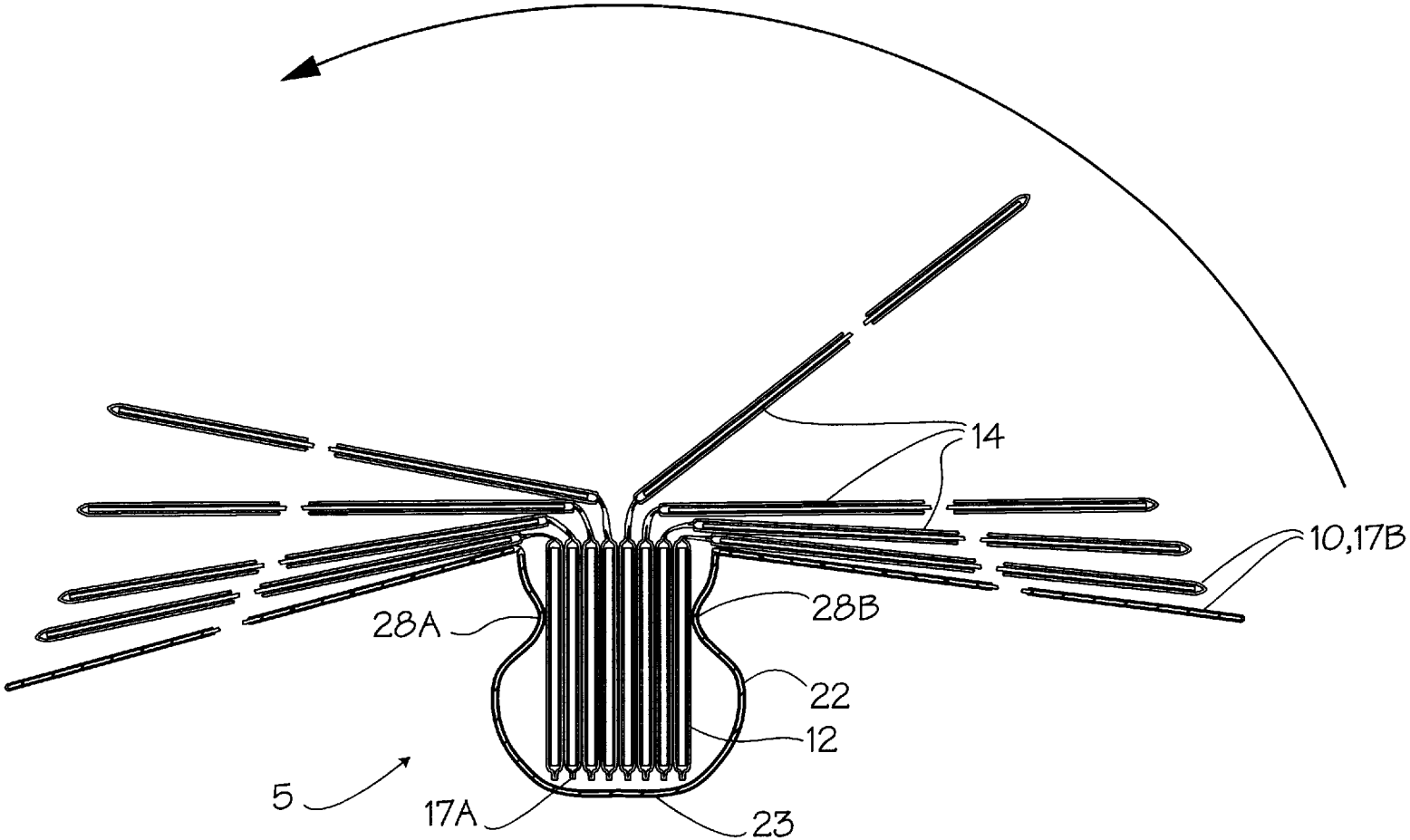
FIG. 6 is a side elevational sectional view of the invention similar to that of FIG. 5 but showing the album apparatus in its open orientation and showing the binder spine having a modified D-shape with an inside peripheral end of a binding portion flush against a flat surface portion of the modified D-shape.

Each one of the album leaf means 10 provides a binding portion 12 and a page portion 14 interconnected by a linear fold portion 16, where the linear fold portion is significantly more flexible than the general flexibility of the page aid binder portions 12 and 14. As shown in FIG. 6, this linear fold portion 16 is wide enough and flexible enough to allow a plurality of album leaf means 10 to lie flat when the album apparatus 5 is opened. As shown in FIG. 1, each of the album leaf means 10 is preferably a sheet of a flexible material such as paper or cardboard. Each of the linear fold portions 16 enables flexible, pivotal rotation of each one of the associated page portions 14 with respect to each one of the associated binding portions 12 of the album leaf means 10, for turning the page portions within the album binder. The linear fold portion 16 of the flexible material preferably includes a plurality of perforations 18 therein. As shown in FIG. 1, the perforations 18 are linearly aligned for establishing a preferred fold line in the album sheet means 10. Alternatively, as shown in FIGS. 2–4, each of the album leaf means 10 can also be formed by two flexible transparent sheets 19A and 19B. These sheets are preferably made out of a plastic such as polyethylene. These two flexible transparent sheets 19A and 19B are preferably heat sealed together around their outer edges such that the heat sealed portion forms the linear fold portion 16. As described above and as shown in FIG. 2, this linear fold portion 16 preferably also includes a plurality of perforations 18 therein. As shown in FIG. 2, a sheet of memorabilia 30 such as photographs, letters, baseball cards, etc., can be placed in the page portion 14 between the two flexible transparent sheets 19A and 19B. As shown in FIG. 4, a stiffener 32 can be placed in the binding portion 12 between the two flexible transparent sheets 19A and 19B. It is preferable to also heat seal the inside and outside peripheral ends 17A and 17B of the album leaf means 10 so that the stiffener 32 and the sheet of memorabilia 30 do not fall out from between the flexible transparent sheets 19A and 19B. To simplify manufacturing, it is possible to simply fold one flexible transparent sheet in half and heat seal the liner fold portion 16 and the inside peripheral end 17A. The outer peripheral end 17B may not need to be heat sealed if it is already closed by a fold in the original sheet.

Figure 5:
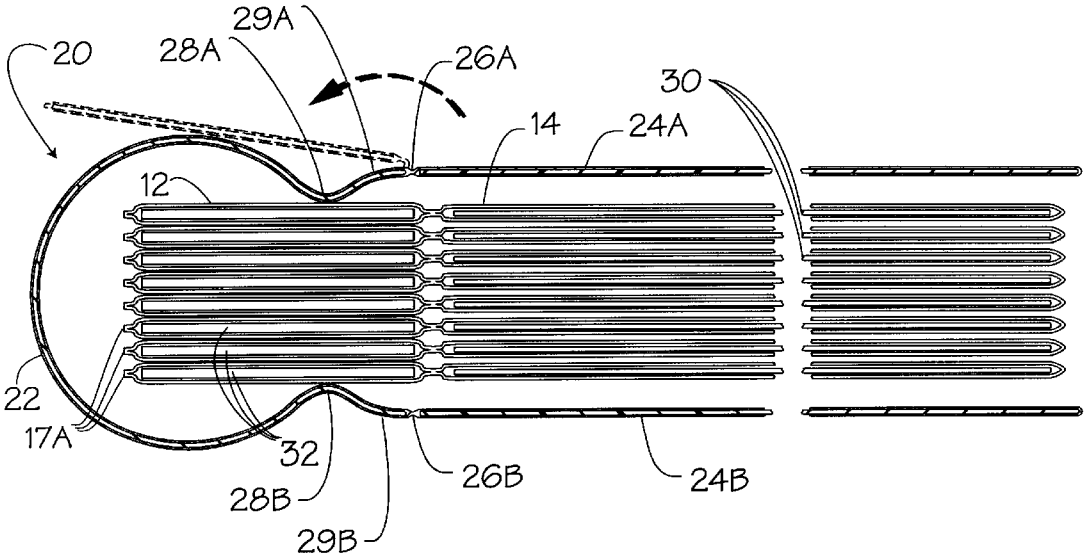
FIG. 5 is a side elevational sectional cut away view of an album apparatus showing the relationship of a binder spine to a plurality of leaves as defined by FIG. 4.

The album binder 20, as shown in FIG. 5, has a resiliently flexible binder spine means 22, a top binder cover means 24A and a bottom binder cover means 24B. Each one of the binder cover means 24A and 24B is attached to the binder spine means 22 with a hinge 26A and 26B respectively, such that the binder cover means may be moved between a first closed orientation and a second open, or folded-back, orientation. The binder spine means 22 is generally either C-shaped or a modified D-shape, to present a pair of opposing linear nip surfaces 28A and 28B which are biased towards each other by the binder spine means 22. However, the shape of the binder spine means 22 is not critical, and many different shapes can accomplish the goal of providing opposing linear nip surfaces 28A and 28B which are biased towards each other. This bias is preferably generated by the natural resilience of the binder spine means 22, although other configurations could be devised by those skilled in the art without deviating from the spirit of the invention. To obtain a natural resilience, the binder spine means 22 is preferably made of metal or hard plastic with this quality. These opposing linear nip surfaces 28A and 28B clamp the binding portions 12 of the plurality of the album leaf means 10 therebetween, thereby removably engaging the plurality of album leaf means 10 within the album binder 20. In its preferred embodiment, the hinges 26A and 26B include small lips 29A and 29B. These lips 29A and 29B extend the hinges 26A and 26B into its preferred position, somewhat removed from the album leaf means 10. As shown in FIG. 5, this configuration allows the user to easily open and close the binder spine means 22 by opening the top binder cover means 24A until it rests on the binder spine means 22 and then pressing down on the top binder cover means 24A using it as a lever to pull the opposing linear nip surfaces 28A and 28B apart. To allow this function, the top and bottom binder cover means 24A and 24B must be made out of rigid material, preferably metal or hard plastic. These top and bottom binder cover means 24A and 24B, as well as the binder spine means 22, can them be covered with other materials and ornamentation to make the invention attractive as an album.

In use, the binding portion 12 of each album leaf means 10 is inserted into the binder spine means 22 such that a portion of the binding portion 12 extends outside of the binder spine means 22. As shown in FIG. 6, this holds the linear fold portion 16 above the hinges 26A and 26B so that the album leaf means 10 can fold at the linear fold portion 16 unobstructed by the Binder spine means 22. The linear fold portions 16 of the various album leaf mans 10 can either be aligned as shown in FIG. 5, or be tiered in some fashion, such as upwards towards the middle of the stack as shown in FIG. 6. Other tiered structures can be arranged as desired. The page portion 14 of the album leaf means 10 extends outward from the binder spine means 22 and is sandwiched between the top and bottom binder cover means 24A and 24B. As described above, a stiffener 32 can be inserted into the binding portion 12 to allow the binder spine means 22 to better hold the album leaf means 10.

In its preferred embodiment, as shown in FIG. 6, the binder spine means 22 has a modified D-shape so as to present a pair of opposing linear nip surfaces 28A and 28B positioned for clamping the binding portions 12 of the album leaf means 10 therebetween, thereby removably engaging the plurality of album leaf means 10 within the binder spine means 22. The binder spine means 22 further having a flat surface portion 23 positioned so that when the inside peripheral end 17A of the binder portion 12 of the album leaf means 10 abuts the flat surface portion 23, the linear fold portions 16 are aligned and positioned outside of the binder spine means 22 whereby each of the linear fold portions 16 enables flexible, pivotal rotation of each one of the associated page portions 14 with respect to each one of the associated binding portions 12 of the album leaf means 10, for turning the page portions 14 within the album binder 20, and for enabling each of the page portions 14 to stack, in turn, in an open readable position.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. An album apparatus comprising:

a plurality of an album leaf means, each one of the album leaf means providing a binding portion and a page portion, the binding and page portions being interconnected by a linear fold portion, the linear fold portion being more easily folded or bent then the binding and page portions;

an album binder having a resiliently flexible D-shaped binder spine means and hinged thereto, a binder cover means such that the binder cover means may be moved between a first closed orientation and a second open, or folded-back, orientation;

the binder spine means having a shape so as to present a pair of opposing linear nip surfaces for clamping the binding portions of the plurality of the album leaf means therebetween, thereby removably engaging the plurality of album leaf means within the album binder with the linear fold portions of the album leaf means aligned and positioned adjacent to the linear nip means, the page portions extending away from the binder spine means;

the binder spine means further having a flat surface portion positioned so that with an inside peripheral edge of the binder portions of each of the album leaf means abutting and aligned on the flat surface portion, the linear fold portions of all of the album leaf means are aligned and positioned outside of the linear nip surfaces of the binder spine means whereby each of the fold portions enables flexible, pivotal rotation of each one of the associated page portions with respect to each one of the corresponding binding portions of the album leaf means, for turning the page portions within the album binder, and for enabling each of the page portions to stack, in turn, in an open readable position.

2. The apparatus of claim 1 wherein the album leaf means is a sheet of a flexible material, the fold portion being a plurality of perforations therein, the perforations being linearly aligned for establishing a preferred fold line in the material sheet.

3. The apparatus of claim 1 wherein the album leaf means is a pair of mutually aligned sheets of a flexible transparent material, the sheets being joined along a linear margin to establish the fold portion.

4. The apparatus of claim 3 wherein the fold portion provides a plurality of linearly aligned perforations for establishing a preferred fold line in the material sheet.

5. The apparatus of claim 3 wherein the binding portion encloses a stiffener means.

6. A combination album apparatus and album leaf means, the combination comprising:

a stack of individual album leaf means, each one of the leaf means providing a binding portion and a page portion, the binding and page portions being interconnected by a flexible and resilient linear fold portion, the linear fold portion having greater flexibility than the binding and page portions;

an album binder having a resiliently flexible binder spine means and hinged thereto, a binder cover means;

the binder spine means having a modified D-shape so as to present a pair of opposing linear nip surfaces positioned for clamping the binding portions of the stack of album leaf means therebetween, thereby removably engaging the plurality of album leaf means within the binder spine means;

the binder spine means further having a flat surface portion positioned so that with an inside peripheral edge of the binder portions of each of the album leaf means abutting and aligned on the flat surface portion, the linear fold portions of all of the album leaf means are aligned and positioned outside of the linear nip surfaces of the binder spine means whereby each of the fold portions enables flexible, pivotal rotation of each one of the associated page portions with respect to each one of the corresponding binding portions of the album leaf means, for turning the page portions within the album binder, and for enabling each of the page portions to stack, in turn, in an open readable position.

7. The apparatus of claim 6 wherein each of the album leaf means is a sheet of a flexible material, the fold portion being a plurality of perforations therein, the perforations being linearly aligned for establishing a preferred fold line in the material sheet.

8. The apparatus of claim 6 wherein each of the album leaf means is a pair of mutually aligned sheets of a flexible transparent material, the sheets being joined along a linear margin to establish the fold portion.

9. The apparatus of claim 6 wherein the fold portion provides a plurality of linearly aligned perforations for establishing a preferred fold line in the material sheet.

10. The apparatus of claim 6 wherein the binding portion encloses a stiffener means.

* * * * *